United States Patent [19]

David, Jr.

[11] 4,240,594

[45] Dec. 23, 1980

[54] CREEL

[75] Inventor: John M. David, Jr., Gainesville, Ga.

[73] Assignee: RCA Corporation, New York, N.Y.

[21] Appl. No.: 21,327

[22] Filed: Mar. 16, 1979

[51] Int. Cl.[3] ..... B65H 49/02; D01H 13/04

[52] U.S. Cl. ..... 242/131; 57/90

[58] Field of Search ..... 57/58.3, 66, 58.36, 57/75, 270, 281, 90, 1, 352; 242/130, 131, 131.1

[56] References Cited

U.S. PATENT DOCUMENTS

| | | | |
|---|---|---|---|
| 3,304,026 | 2/1967 | Bucklow et al. | 242/131 |
| 4,163,357 | 8/1979 | Grieve et al. | 242/131.1 X |
| 4,175,717 | 11/1979 | Mathiolon et al. | 242/131 |

*Primary Examiner*—Donald Watkins

*Attorney, Agent, or Firm*—Samuel Cohen; William Squire

[57] ABSTRACT

A creel for a twisting machine includes an arm which is pivotally mounted at its upper end to a point on a support over an aisle alongside of the machine and which secures at its lower end a peg supporting element which may be arc shaped. The creel normally is latched in a stowed position above the twisting machine not blocking the aisle, and in this position yarn from spools on the pegs of the creel is supplied to the twisting machines. When it is desired to remove the empty spools and replace them with full ones, the latch is released, whereby gravity causes the creel to swing to a second position, this one over the aisle adjacent to the machine and sufficiently lower than the stowed position that the spools easily are accessible to an operator.

12 Claims, 5 Drawing Figures

CREEL

Figure 1:
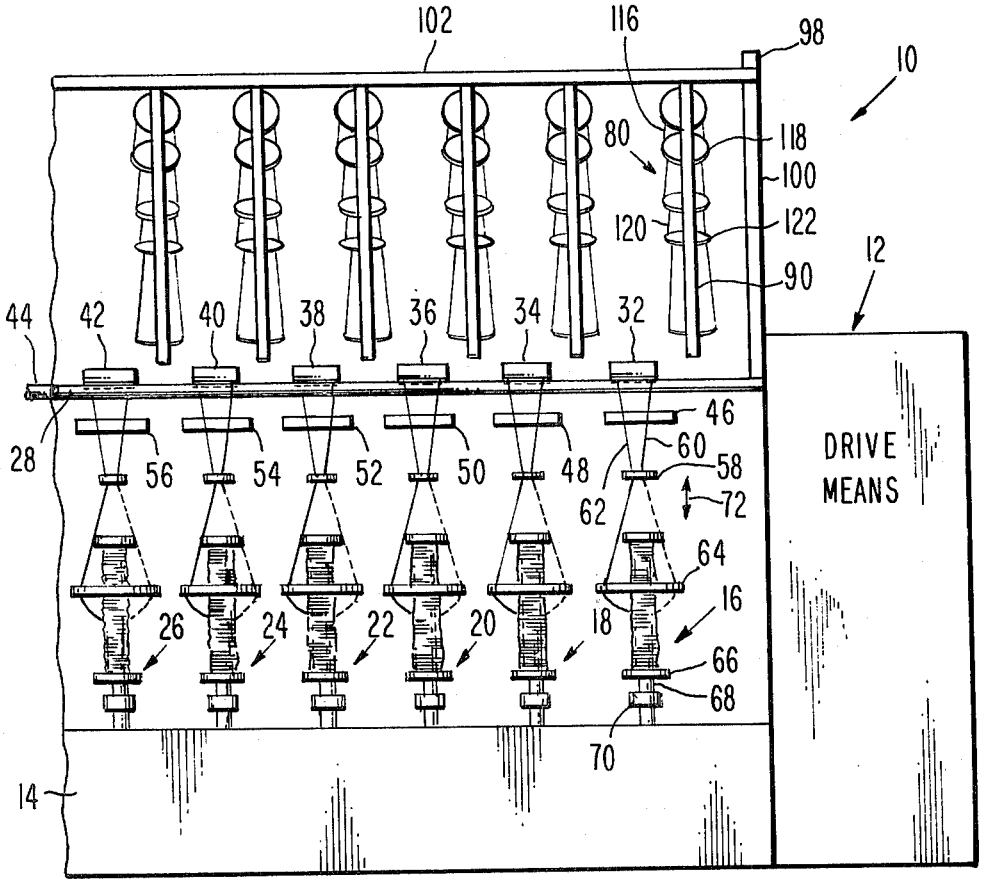

The present invention relates to creels for use with a yarn twisting machine.

Yarn twisting machines or "twisters" as they are more generally known, comprise relatively long machines having two rows of twisting stations, one on each side of the machine. One machine, known as the Collins Twister, has 128 such stations, 64 on each side of the machine. Other twisters have as many as 192 stations, 96 on each side of the machine. The functions performed at such a "twisting station" are the twisting together of two or more input yarns to produce a twisted yarn and the winding of the latter onto a single bobbin to form a spool of such twisted yarn. The input yarns are fed from spools mounted on pegs located on creels which are close to the twisting stations. One widely used creel is formed of a floor mounted rectangular framework or rack that is spaced from and runs the length of the twisting machine and two creels are needed for each twister machine, one for each side of the machine. The amount of floor space occupied by the two creels servicing a twister machine is generally greater than the space occupied by the machine.

There is also known in the art an alternative arrangement which requires less floor space than the one described above. Here, rather than "floor mounting" the creels, that is, locating them on both sides of each twisting machine, they are instead positioned above the twisting machine. One type of such creel has a number of link arms which are folded over upon one another in a stored position to form a compact arrangement. Several pegs are mounted on one of the link arms. To load the pegs, the linkages are unfolded, until the link with the pegs is next to the machine over the aisle where an operator can conveniently load new spools of yarn. After loading, the linkages are returned to the folded stowed position. A separate creel is required for each twisting station. This construction, while significantly more compact than the floor mounted rack type creels, is relatively costly due to the added complexity.

In a yarn twisting apparatus including a plurality of bobbin supporting spindles and means for twisting and winding the yarn about bobbins mounted on the spindles, a creel in accordance with the present invention for supporting spools of yarn to be twisted and wound by the apparatus at one of the spindles comprises an elongated support member rotatably mounted at one end at an elevation above the apparatus. A cross member is secured to the other lower end of the elongated member and latch means are secured to the cross member for securing the creel to the twister in a stored position. A plurality of pegs extend from one side of the cross member and lie in a plane formed with the cross member and support member.

Figure 3:
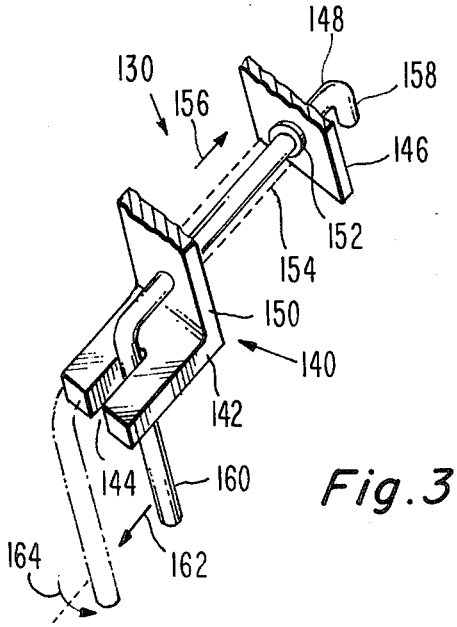
Figure 4:
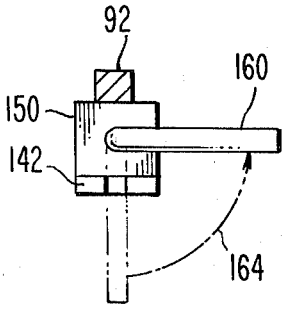
Figure 2:
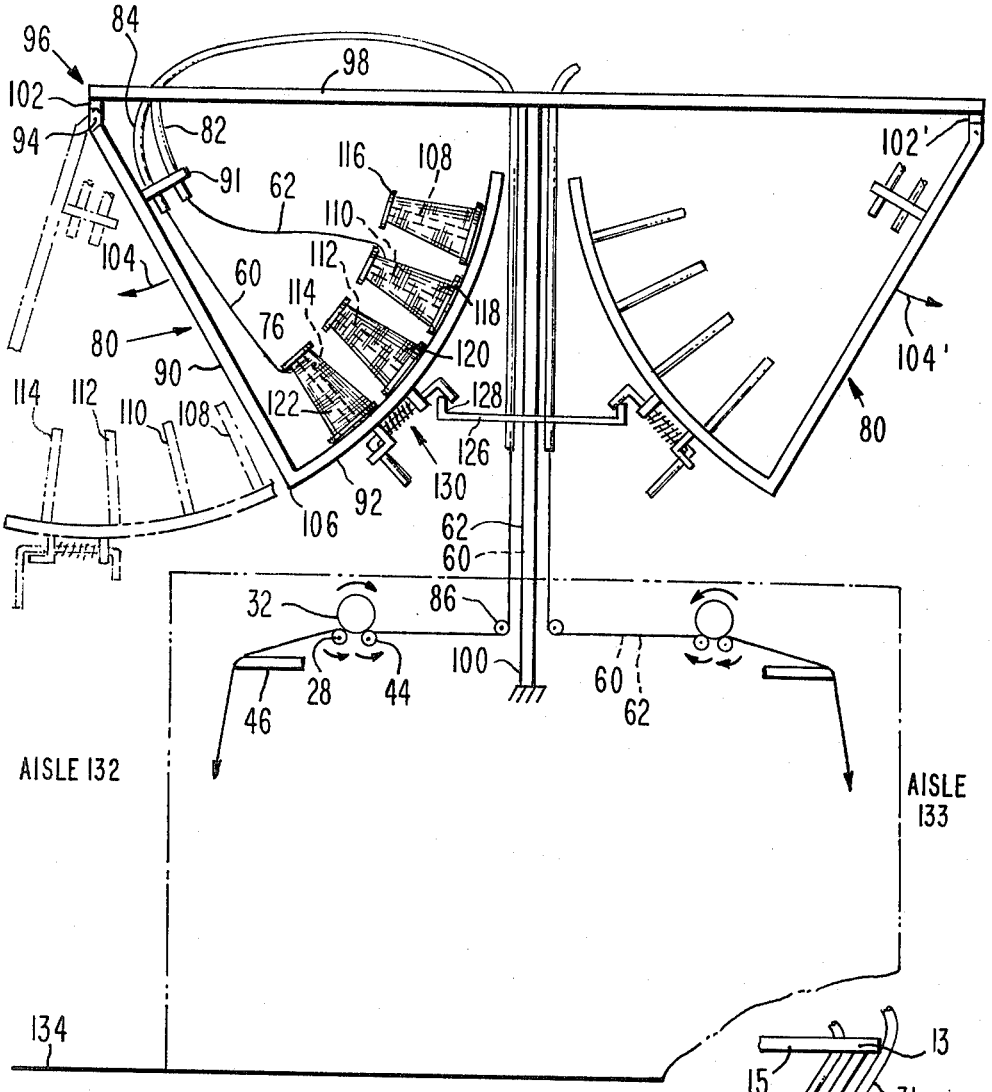
Figure 5:
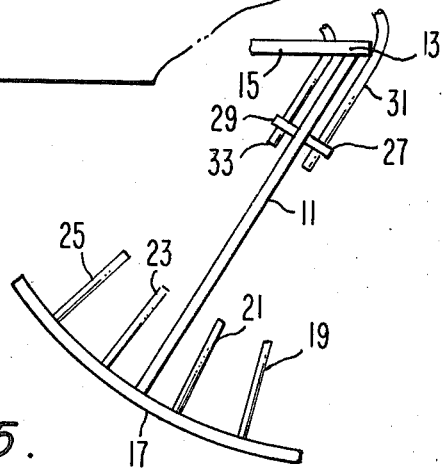

In the drawing:

FIG. 1 is a fragmented side elevation schematic view of a twister and creel assembly embodying the present invention, FIG. 2 is an end view of the assembly of FIG. 1 showing the creels in more detail and the twister in broken outline, FIG. 3 is a perspective view of the latch assembly attached to each of the creels of FIGS. 1 and 2, FIG. 4 is an end view of the latch assembly of FIG. 3, and FIG. 5 is an end view of a creel in accordance with a second embodiment of the present invention.

In FIG. 1 a conventional twister 10 is a machine which twists two or more yarns onto a bobbin forming a spool of twisted yarn. One such machine is known as a Collins Ring Twister. Only so much of the twister is illustrated as will be useful in illustrating the present invention. It is to be understood that the twister 10 is a relatively complex machine in which the details are well known and need not be explained or described herein. Machine 10 includes drive means 12 which include motors, gear boxes and related mechanisms, and controls for driving the various shafts and actuating mechanisms used in the twisting of yarns. Mounted on base 14 are a plurality of twisting stations 16, 18, 20, 22, 24 and 26. These are but a few of many stations aligned in a row on each side of the twister. Stations 16–26 are aligned in a row next to aisle 132, FIG. 2, while a second row of twisting stations is aligned in a row next to aisle 133. In practice, there may be 64 stations on each side of twister 10. Each station is of the same construction and, therefore, only one will be described in general terms.

Rotatable shaft 28 extends the length of twister 10 and is rotatably driven by drive means 12. Mounted at the twisting stations 16–26 are rollers 32, 34, 36, 38, 40 and 42, respectively, these being rotatable about an axis which is parallel to the axis of shaft 28. A second shaft 44 (FIG. 2) extends the length of the machine through all of the twisting stations. Rollers 32–42 are in rolling contact with shafts 28 and 44. Mounted adjacent roller 28 at the respective stations are yarn guide brackets 46, 48, 50, 52, 54 and 56. These brackets guide the yarns 60 and 62 to be twisted. Additional yarn guide apparatus 58 is mounted for receiving the yarns 60 and 62 to be twisted at station 16. Similar guides are at each station. A ring member 64 coacts with the guide apparatus 58 by reciprocating in the vertical direction to guide the yarns 60 and 62 around the bobbin 66 about which the yarns are to be wound. The yarns 60 and 62 are twisted together as they are wound on bobbin 66. Bobbin 66 is mounted on a spindle 68 which is rotatably driven by a belt 70 via the drive means 12. The guide apparatus 58 and ring 64 oscillate in the directions 72 in a well known manner for twisting and guiding the yarns 60 and 62 onto the bobbin 66. Additional mechanisms (not shown) such as cams and levers operate the various operating linkages and drives in unison at each of the stations.

The yarns 60 and 62 are threaded between the rollers 32–42 and shafts 28 and 44, which are driven in a direction for feeding the yarns onto the bobbin 66. The yarns 60 and 62 at station 16 are supplied from spools 118 and 122 mounted on creel 80. The yarns from spools 118 and 122 are fed through respective plastic tubes 82 and 84 (FIG. 2) to a point above guide shaft 86 which extends the length of the twister. The yarns then pass under shaft 86 and then between roller 32 and shafts 28 and 44.

In FIG. 2 the creel 80, which is typical of the creels at each station, is mounted for use at station 16. The creel comprises main supporting arm 90 and a lower arcuate leg 92 which is approximately at right angles to arm 90 at the region where the two join, that is, at 106 at the lower end of arm 90. The upper end of arm 90 is rotatably mounted at 94 to an overhead support frame 96. Frame 96 comprises a cross arm 98 which is mounted on an upright support 100 secured to the framework of twister 10. A plurality of cross arms 98 are spaced along the length of the twister 10. Runners 102 are secured to the ends of cross arms 98 and run the length of the twister. Runner 102 is on one side of the twister machine above aisle 132 and a similar runner 102' is located on the opposite side of the machine. The two halves of the creel assembly are mirror images of one another. Each creel 80 mounted on runner 102 is independently rotatable in angular direction 104, each creel 80 mounted on runner 102' is independently rotatable in direction 104'. The pivot axis of the row of creels on a side of twister 10 may be on a common axis or substantially parallel axes. Arm 90 and leg 92 may be made of suitable steel bar stock and welded together at junction 106. Four upright spool supporting pegs 108, 110, 112 and 114 are mounted on leg 92 approximately equally spaced from each other. Pegs 108–114 lie in a plane with leg 92 and arm 90. The pegs receive spools 116, 118, 120 and 122, respectively, of yarn to be twisted at station 16. As can be seen in FIG. 2, only spools 118 and 122 are now being utilized. When these spools empty an operator may take the yarns from full spools 116 and 120 and feed them to the twister at station 16. A separate plastic tube 82 and 84 is provided for each yarn to be twisted. To simplify illustration, only two plastic tubes are shown on each side. In practice, two tubes are located at each station 16–26. The tubes are secured to arm 90 via brace 91 attached to arm 90 and to the rest of the structure by ties. Mounted to the twister framework (not shown) which extends the length of the twister is a latch support brace 126. Running the length of the twister and attached to latch brace 126 is an upstanding leg 128 which may be formed of standard angle iron material.

Mounted to the underside of the leg 92 of creel 80 is latch assembly 130. The latch assembly 130 latches on to the angle 128 to secure the creel 80 in the stored position, shown in solid line. Release of the latch assembly 130 results in gravity pulling the creel assembly in the direction 104, swinging it down over the aisle 132 in the position shown in broken line. Here an operator standing in aisle 132 conveniently may remove empty spools from the pegs and replace them with new spools of input yarn. When a creel is in its down position shown dashed, its pegs 108–114 are approximately 4 to 5 feet above the floor 134 and are relatively easily accessible by a person standing in aisle 132. In practice, while the twister is operating and twisting yarns from spools mounted on the creel, the empty bobbins may be replaced with full bobbins without stopping the machine. The creel assembly 80 may then be simply pushed back to the storage position in a direction opposite direction 104 and latched in place by latch 130.

In FIG. 3, the latch assembly 130 is shown in more detail. The latch comprises an angle member 140 having a leg 142 with a slot 144. A member 146 depends from the underside of arm 92 as does the angle member 140. A U-shaped rod 148 is mounted through an aperture in member 146 and in upstanding leg 150 of member 140. A washer 152 is secured to the rod 148. A compression coil spring (shown dashed) 154 forces the rod 148 via washer 152 in the direction 156. This locks leg 160 in slot 144. Leg 158 of rod 148 engages the angle 128 (FIG. 2) to hold the creel 80 in place. To disengage the creel, the handle 160 of rod 148 is pulled in the direction 162 with respect to the leg 92, FIG. 2, of the creel until the handle 160 disengages from the slot 144. The handle 160 is then rotated counterclockwise in the direction 164 until the leg 158 disengages from angle 128. When the leg disengages, gravity causes the creel to pivot around point 94 in the direction 104 until it reaches an equilibrium position as shown in broken line. To engage the latch mechanism the above sequence is reversed. Alternative latch mechanisms are available and may be utilized instead of the one shown.

While four pegs are shown on each creel assembly, it is apparent that any number of pegs may be provided in accordance with a given implementation. Being a relatively simple structure, each creel assembly, having relatively few moving parts, is inexpensive and takes up relatively little room on the twister. As a result, a large number of spools of yarn may be stored on a twister machine without utilization of valuable floor space and may be readily placed in either a storage or load position by an operator in a minimum amount of time and at relatively little inconvenience.

In FIG. 5 is shown an alternate construction for a creel assembly. Here the arm 11 is pivotally mounted at 13 to the upper support 15 in a manner similar to that described with the creel assembly 80 of FIG. 2. In this case the arm 11 is mounted centrally of the arcuate leg 17 instead of at one end thereof. A number of pegs 19, 21, 23 and 26 are mounted to the leg 17 in a manner similar to that for creel 80. A pair of plastic tube supports 27 and 29 are secured to the arm 11 for mounting the terminating end of the plastic tubes 31 and 33.

While the lower leg 17 and 92 of the creel assemblies of FIGS. 2 and 5 have been shown to be preferably arcuate, it is readily apparent that they need not be arcuate to serve the desired purpose.

What is claimed is:

1. In a yarn twisting apparatus between first and second aisles including a plurality of bobbin supporting spindles and means for twisting and winding yarn about bobbins mounted on said spindles, a creel for supporting spools of yarn to be twisted and wound by said apparatus comprising:

creel support means located at a level above said twisting and winding means and above one of said aisles, a creel member including an arm member, a leg member, and a plurality of pegs mounted solely on the leg member, a line passing through the junction between the leg and arm members and the pivot axis being at about right angles to the leg member at the region of the leg member closest the arm member, said creel member being pivotally mounted to said support means about a single fixed pivot axis above said one aisle to permit movement of the creel leg member from a first storage position at a location above said means for twisting and winding to a second lower horizontal load position alongside said yarm twisting apparatus above said one aisle with its pegs approximately upright, and means for releaseably securing said creel member in its first position.

2. The creel of claim 1 wherein said means for releaseably securing said creel member in its first position comprises a latch device secured to the underside of said leg member and facing said twisting apparatus, and a latch receiving member secured above said machine, said latch device including means for catching said receiving member when said creel is in said first storage position.

3. The creel of claim 1 wherein said releasably securing means includes latch means secured to said creel member and catch means mounted on said apparatus for receiving and locking said latch means thereto when the member is in the first position.

4. The creel of claim 1 wherein said creel member is generally L-shaped.

5. The creel of claim 1 wherein said creel member is T-shaped comprising an elongated extension member pivotally mounted at one end to said support means and a cross member secured to the other end of the extension member, said plurality of pegs being mounted on said cross member and facing in the same direction as said extension member.

6. The creel of claim 1 wherein said creel member includes a straight arm and an arcuate leg fixed to the arm, the pegs being mounted on the leg.

7. In the apparatus of claim 1 a plurality of said creels mounted for parallel rotation about said single pivot axis which is a common axis.

8. A creel for use in a textile machine comprising:

a substantially straight elongated support arm, means rotatably mounting the arm at one end, a cross member secured to the other end of the arm and intersecting the arm at about right angles at the region of the cross member closest to the arm, the arm and cross member lying in a common plane, latch means secured to one of said arm and member, and a plurality of pegs secured solely to said cross member and lying in said common plane.

9. The creel of claim 8 wherein said cross member is arcuate.

10. The creel of claim 8 wherein said support member and said pegs extend in approximately the same general direction from said cross member.

11. In combination:

a yarn twisting machine, a support member above a space next to the side of the machine, a plurality of elongated straight arms rotatably mounted to said support member and depending downward from said support member, said arms rotating about parallel axes, a like plurality of elongated arcuate peg supporting legs each secured to a separate, different one of said arms at a lower end of that arm at about right angles with that arm at a region of the correspondingly closest arm, a plurality of pegs solely on each said legs and lying in a plane with its leg and corresponding arm, and means for releaseably securing the legs to the machine in a storage position above the machine, said legs hanging beneath said support member in said space when released from said storage position and oriented generally horizontally in the released condition.

12. In combination with a yarn twisting machine which, in use, is located between two aisles, one adjacent one edge of the machine and the other adjacent to the opposite edge of the machine, a supporting structure for creels which hold the yarns to be supplied to the machine and the creels themselves comprising:

two creel supporting elements, both located above the yarn twisting machine, one extending beyond said one edge of the machine and the other extending beyond the opposite edge of the machine, said two edges extending in the direction of the length dimension of the machine, said two creel supporting elements extending along the length dimension of the machine beyond the respective edges; and one group of creels pivotally supported by one of said creel supporting elements at spaced positions along the length of that element beyond one of said edges and a second group of creels pivotally supported by the other creel supporting element along spaced positions of that element beyond the other of said edges, each creel lying in a plane, the planes of the creels being substantially parallel to one another and the planes being substantially perpendicular to the length dimension of said machine, each such creel comprising:

a straight arm pivotally mounted at its upper end to one of said creel supporting elements beyond the corresponding edge and fixed at its lower end to a peg supporting element, the peg supporting element being of generally arc shape and extending at about right angles from said arm at a region of the element closest to the arm; the arm being free to swing in response to the force of gravity unless otherwise latched in place, and said peg supporting element when unlatched, assuming a generally horizontal orientation;

a plurality of upright pegs fixed solely to said peg supporting element, said pegs for supporting spools of yarn;

latching means secured to said creel for normally holding the creel in a stowed position over the twisting machine, and when in use, out of the way of the aisle adjacent to the machine, the creel, when in said stowed position and with spools of yarn in place on the spindles, being in position to supply yarns to said yarn twisting machine; and means for releasing said latching means, whereby said creels may swing from the stowed position about the pivotal connection of the arm of the creel with a creel supporting element in response to the force of gravity, to a second position, this one over an aisle, when the twisting machine is in use with said pegs extending generally vertically, whereby empty spools conveniently may be accessed by an operator and replaced with full spools.

* * * * *